United States Patent [19]

Becker

[11] 3,982,653

[45] Sept. 28, 1976

[54] PARTITION WALL FOR TANKER CARRYING CRYOGENIC-TEMPERATURE LIQUID

[75] Inventor: Rudolf Becker, Munich, Germany

[73] Assignee: Linde Aktiengesellschaft, Wiesbaden, Germany

[22] Filed: May 12, 1975

[21] Appl. No.: 576,310

[30] Foreign Application Priority Data

May 14, 1974 Germany ..... 2423287

[52] U.S. Cl. ..... 220/9 LG; 220/16; 220/22

[51] Int. Cl.[2] ..... B65D 25/18; B65D 25/00; B65D 85/00

[58] Field of Search ..... 220/16, 9 LG, 20, 21, 220/22, 83, 85 S, 71

[56] References Cited

UNITED STATES PATENTS

| | | | |
|---|---|---|---|
| 2,092,504 | 9/1937 | Frear | 220/83 |
| 2,618,401 | 11/1952 | Wilkin | 220/20 |
| 2,820,568 | 1/1958 | Zick et al. | 220/22 |
| 2,968,161 | 1/1961 | Bliss | 220/9 LG X |
| 3,004,509 | 10/1961 | Leroux | 220/9 LG |
| 3,414,155 | 12/1968 | Corvino | 220/22 X |

*Primary Examiner*—William Price
*Assistant Examiner*—Steven M. Pollard
*Attorney, Agent, or Firm*—Karl F. Ross; Herbert Dubno

[57] ABSTRACT

The interior chamber of a tanker is subdivided into at least two compartments by a partition wall that is formed of Invar steel and is at the same temperature as the liquids in the two compartments. The partition is rigidly secured to the bottom wall of the tanker and generally planar, with limited ability to expand and contract in the direction of its plane. This is effected by forming the partition of one or more upright tubes of round or square cross section interconnected, if desired, by webs lying in or at an angle to the plane. It is also possible to connect the outer edge of the partition to the side wall of the tanker by means of a panel tightly secured in a frame but slidable relative thereto to allow limited expansion and contraction.

13 Claims, 10 Drawing Figures

PARTITION WALL FOR TANKER CARRYING CRYOGENIC-TEMPERATURE LIQUID

CROSS-REFERENCE TO RELATED APPLICATION

This application is related to co-pending patent application Ser. No. 400,806 filed Sept. 26, 1973.

FIELD OF THE INVENTION

The present invention relates to a container for cryogenic gas. More particularly this invention concerns a tanker for liquefied natural gas or the like maintained at cryogenic temperatures.

BACKGROUND OF THE INVENTION

Liquefied gas and the like is transported in tankers in a liquid state. Thus the gas is cooled to a cryogenic temperature where its volatility is low and it is very easy to handle.

As a rule the chamber inside the tanker is subdivided by one or more partitions into a plurality of liquid-containing compartments. These separate compartments mainly serve to prevent the ship from sinking should the outer hull be pierced. Thus in case of accident only one of the compartments will be opened, only part of the cargo lost, and the tanker will remain afloat.

The partition walls are usually of a very heavy construction and provided with considerable insulation and heating equipment so as to protect these walls from the extreme low temperatures of the cryogenic liquids. Thus the walls frequently attain an overall thickness of 2.5 to 3 meters, and the space in the walls of the container approximately 0.5 meters. Thus in a tanker having four compartments, therefore having three coffer dams or partitions, the overall wall thickness is some 10 to 12 meters, equal to approximately 4.5% of the length of a tanker having an overall volume of 125,000 cbm. This type of construction raises the price of the tanker by approximately 3 million dollars.

In double-hulled ships such partitions are not needed for rigidifying the tanker, but are usually included only to protect against accidents as described above. Such ships are, however, extremely expensive to manufacture.

Objects of the Invention

It is therefore an object of the present invention to provide an improved container of the above-described general type.

Another object is the provision of an improved tanker.

Another object is the provision of an improved partition arrangement which prevents fluid flow between adjoining compartments, fluid here covering both liquid and gas.

Summary of the Invention

These objects are attained according to the present invention by subdividing the compartments of the container with uninsulated partition walls formed principally of cold-resistant material, such that the partitions are at a temperature equal to that of the cryogenically cooled liquids in the compartments. Dispensing with the insulation and heating in this manner leaves a great deal of room inside the container.

According to another feature of this invention means is provided for elastically connecting the side edges of the partition and the side walls of the container so as to permit this partition to expand and contract in the direction of the plane it lies generally on. At the same time the partition is rigidly and securely fixed to the bottom wall of the container. Thus should one of the compartments be damaged and fill with water the partition can readily take the considerable pressure. A rigid connection between the bottom edge of the partition and the bottom wall of the container can be affected by welding, screwing, bolting, or riveting. The elastic connection between the partition and the side walls of the container can be effected by means of a particular elastic edge element such as a thin-walled tubing, a V-shaped or concave metal strip, or a U-shaped frame in which a planar plate is gas and water tight but movably fitted.

According to another feature of this invention the interior insulation of the bottom and side walls of the container can be thickened at the regions where the edges of the partition wall are connected thereto. This considerably reduces heat losses resulting from conduction of heat to the partition wall through the insulation.

In accordance with another feature of this invention the partition wall is formed at least partially of upright tubes of cylindrical or polygonal section. This considerably increases the horizontal elasticity in the plane of the wall and the rigidity perpendicular thereto. These tubes can be interconnected by webs which either are formed as flat planar plates as one or more upright part cylindrical plates. When two plates are used they are placed back to back and concave away from each other. With such an arrangement an extremely rigid and inexpensive partition can be created. It also lies within the scope of this invention to fill the tubes of such a partition wall either with cryogenic liquids so as to use them as further storage facilities, or with a stiffening mass.

In accordance with this invention the stiffening mass can be sand or synthetic-resin foam. The tubes need merely be filled to a level corresponding to a maximum filling height of the compartment, as this is the greatest depth to which the compartments would be filled should a leak occur.

In accordance with another feature of this invention the partition wall is corrugated with trapezoidal section portions that are fitted between the separate parts of the container as described in the above-cited copending application. This embodiment is particularly economical of space.

According to yet another feature of this invention the partition wall is made of steel capable of withstanding extremely low temperatures. Such steels as a rule are generally poor conductors of heat. Thus in accordance with the present invention Invar metal is used, and iron-nickel base alloy containing 36% nickel and 0.3% copper. This metal has an extremely low coefficient of linear expansion so that it is possible to make a planar cofferdam or partition therewith.

According to the present invention it is not necessary to connect the top edge of the partition wall with the underside of the ship deck constituting the top wall of the container. This is possible because in case of leakage water in one of the compartments will not rise to the deck level so as to be able to flow from compartment to compartment unless the entire ship sinks. Instead it is possible to seal the compartment off relative to each other at least to prevent gas flow therebetween, as by providing membranes between the partitions and the bottom of the deck so as to permit gas analysis of the gas above the liquid in each compartment and thereby allow the state of the contents to be checked. It is also possible to seal the top edge much like the side edge if desired.

BRIEF DESCRIPTION OF THE DRAWING

The above and other objects, features, and advantages will become more readily apparent from the following, reference being made to the accompanying drawing in which.

SPECIFIC DESCRIPTION

Figure 1A:
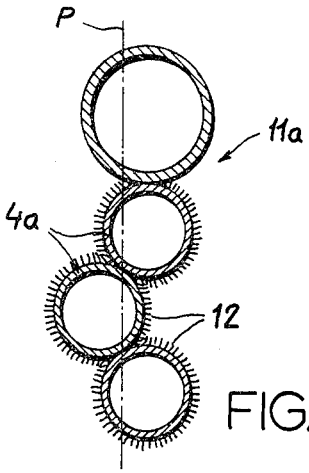
FIGS. 1*a*–1*f* are horizontal sections through walls according to the present invention.

As shown in FIG. 1*a* a wall 11*a* is formed of a plurality of parallel circular-section tubes 4*a* staggered relative to a partition plane P and secured via weld 12 to the bottom wall of the tanker. In addition these tubes 4*a* are welded to one another so as to form a fluid tight wall.

Figure 1B:
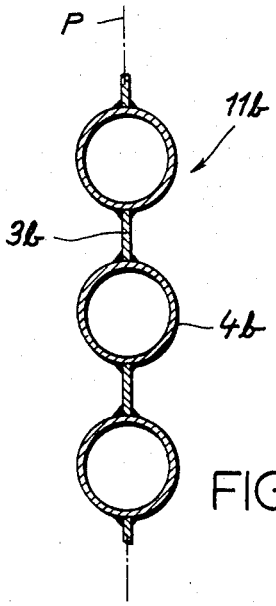

The arrangement shown in FIG. 1*b* has a partition 11*b* formed of tubes 4*b* identical to tubes 4*a* but arranged in line relative to the plane P and separated by planar metal webs 3*b* that are welded to diametrically opposite sides of the tubes 4*b*. The arrangement of FIGS. 1*a* and FIG. 1*b* are both made of Invar steel.

Figure 1C:
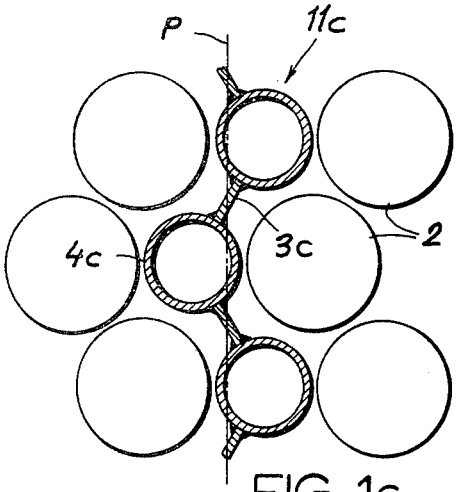

In FIG. 1*c* an arrangement is shown which is identical to FIG. 1*b* except that here the tubes 4*c* are staggered to opposite sides of the plane P and the webs 3*c* are similarly inclined relative to this plane P. To either side of the partition 11*c* are shown the holders 2 of the container, as described in commonly assigned U.S. Pat. Nos. 3,831,811, 3,842,613, 3,882,685, and 3,886,885.

Figure 1D:
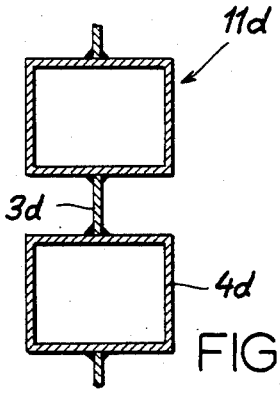

The partition 11*b* of FIG. 1*d* has an in-line row of rectangular-section tubes 4*d* separated by planar web plates 3*d*. This arrangement offers considerable rigidity, as lateral deflection of the tubes 4*d* is resisted strongly by their polygonal shape.

Figure 1E:
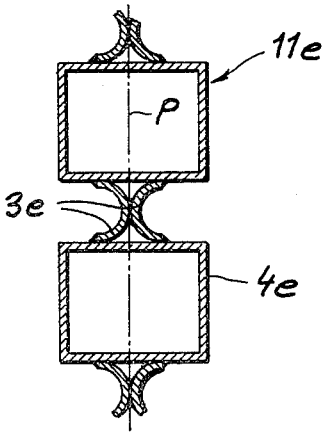

In FIG. 1*e* a partition 11*e* is shown having rectangular-section tubes 4*e* as shown in FIG. 1*d*, but with a pair of semi-cylindrical web parts 3*e* between every two tubes 4*e*. These semicylindrical web parts 3*e* are arranged back to back and concave away from each other so as to offer maximum rigidity but still allow stretching and contracting of the partition 11*e* in the direction of its plane P.

Figure 1F:
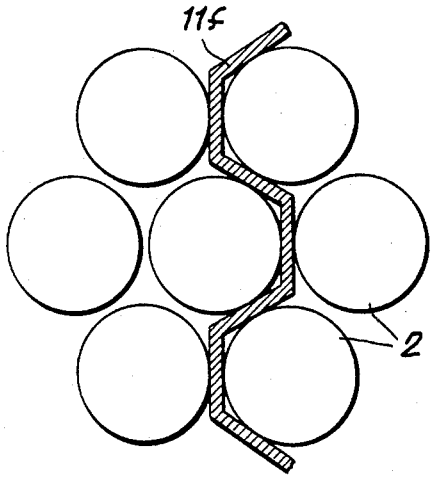

In FIG. 1*f* a partition wall 11*f* of trapezoidally corrugated shape is provided which fits between the upright cylindrical holders 2 as described with reference to FIG. 1*c*. This wall 11*f* therefore fits between the holders, taking up space which is normally unused in a tanker.

Figure 2A:
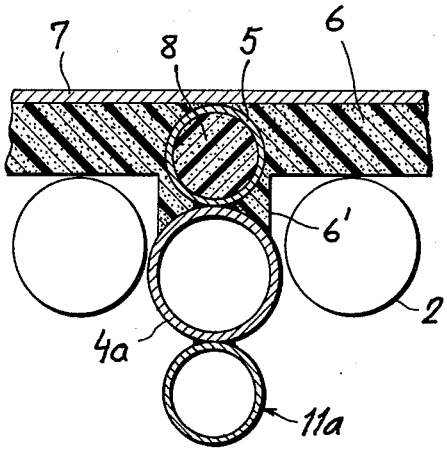
FIGS. 2*a* and 2*b* are horizontal sections at the outside walls illustrating the securing of the partition to the side wall of the container.

The FIG. 2*a* shows the outer wall or hull 7 of a tanker which is covered with a layer 6 of insulation material that is thickened in a region 6′. A wall 11*a* as shown in FIG. 1*a* has its end tube 4*a* secured to the insulating wall 6 at the thickened region 6′ at which is provided an end tube 5 filled with a mass 8 of insulating foam.

Figure 2B:
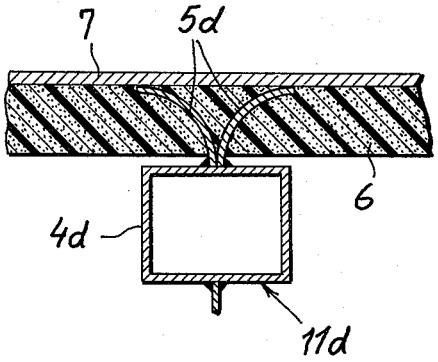

In FIG. 2*b* a wall 11*d* as shown in FIG. 1*d* is shown which is connected via a pair of arcuate-section plates

5*d* to the hull wall 7. These plates 5*d* extend outwardly in opposite directions from the end tube 4*d* and are embedded in the mass of insulation 6.

Figure 2D:
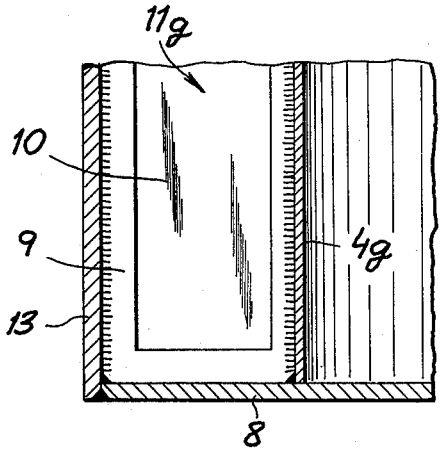
FIG. 2*d* is a vertical section through the arrangement of FIG. 2*c*.
Figure 2C:
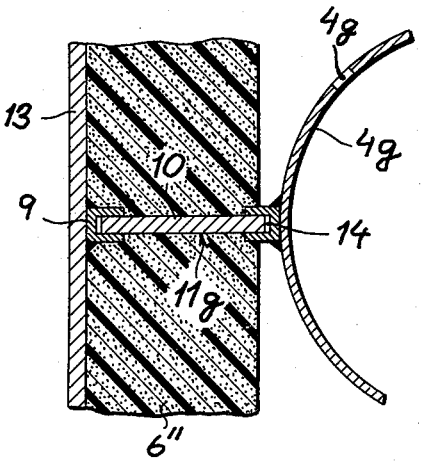
FIG. 2*c* is a horizontal section illustrating another partition according to this invention.

The arrangement shown in FIG. 2*c* and 2*d* shows a wall 11*g* whose end tube 4*g* is welded to a rectangular frame *q* formed of channels one of which is welded to the bottom wall 8 of the wall, and another of which is welded to the side wall 13 of the tanker. A panel 10 is fitted in this channel frame 9 tightly so as to form a gas and liquid tight seal. Play as illustrated at 14 is left between the outer edges of the panel 10 and the channel 9 so that limited displacement of this panel is possible in the frame 9 without leakage. In addition the entire panel and frame 9 are embedded in a mass of insulation material 6″. FIG. 2*c* also shows how the end tubes 4*g* are formed with holes 4*g′* which open to one side of the wall 11*g* and allows the interior of this tube 4*g* to fill with the cryogenic liquid. Thus the wall 11*g* serves to rigidify the tanker and act as a bulkhead between adjoining compartments while at the same time it also serves as a storage facility.

I claim:

1. A container for transporting liquid at cryogenic temperatures, comprising:

wall means including at least one vertical side wall and and a horizontal bottom wall defining a receptacle for said liquid;

a partition upstanding in said receptacle and subdividing same into separate liquid-containing compartments;

means yieldably connecting said partition to said side wall;

means securing said partition to said bottom wall; and a layer of thermal insulation along said side wall, said partition being formed of cold-resistant metal and being maintained at substantially the same temperature as the cryogenic liquid in said compartment, said partition comprising a series of spaced apart parallel vertical tubes and pairs of back-to-back strips concave outwardly from one another bridging successive tubes and formed nonplanar webs between them.

2. The container defined in claim 1 wherein said tubes are of rectangular horizontal cross section.

3. The container defined in claim 2 wherein said tubes lie in a common plane.

4. The combination in a tank ship having a hold, with wall means of said hold including at least one vertical side wall and one horizontal bottom wall defining a receptacle for a cryogenic liquid, of:

a partition upstanding in said receptacle and subdividing same into separate liquid containing compartments;

means yieldably connecting said partition to said side wall;

means securing said partition to said bottom wall; and a layer of thermal insulation lining said receptacle at least along said side wall, said partition being formed of cold-resistant metal and being maintained at substantially the same temperature as the cryogen liquid in said compartment, said partition having successive sections composed of tubes, and means connecting said tubes together.

5. The tank ship defined in claim 4 wherein the webs connecting said tubes together are plates of said metal welded to said tubes.

6. The tank ship defined in claim 4 wherein said tubes have their axes disposed alternately on opposite sides of a plane through said partition in zigzag fashion.

7. The tank ship defined in claim 4 wherein said partition is made of INVAR steel.

8. The tank ship defined in claim 4 wherein said means yieldably connecting said partition to said side wall includes an arcuate metal element of greater flexibility than the last tube of said partition and said side wall and embedded in said insulation.

9. The tank ship defined in claim 8 wherein said element is another tube.

10. The tank ship defined in claim 9 wherein said other tube is filled with thermal insulation.

11. A container for transporting liquid at a cryogenic temperature, comprising:

wall means including at least one vertical side wall and one horizontal bottom wall defining a receptacle for said liquid;

a partition of a cold-resistant metal substantially at the same temperature as the liquid in said receptacle disposed therein and consisting of successive sections concave alternately in opposite directions and joined together, said sections having a first wall thickness;

means yieldably connecting said partition to said side wall;

means securing said partition to said bottom wall; and a layer of thermal insulation along said side wall, said means yieldably connecting said partition to said side wall including an arcuate metal element of a wall thickness less than said first wall thickness and embedded in said layer of insulation.

12. The container defined in claim 11 wherein said element and said partition are composed of INVAR steel.

13. The container defined in claim 12 wherein said element is a tube welded to said partition.

* * * * *